United States Patent [19]

Gamble

[11] 4,059,222

[45] Nov. 22, 1977

[54] NEWSPAPER RECYCLING APPARATUS AND METHOD

[76] Inventor: Bruce Gamble, 815 Rosedale Ave., Lafayette, Calif. 94549

[21] Appl. No.: 705,196

[22] Filed: July 14, 1976

Related U.S. Application Data

[63] Continuation-in-part of Ser. No. 506,090, Sept. 16, 1974, Pat. No. 3,977,596.

[51] Int. Cl.[2] ..... B65D 33/12; B65D 33/24

[52] U.S. Cl. ..... 229/54 R; 150/7; 229/62

[58] Field of Search ..... 229/54 R, 62, 84, 52 B; 150/1.7

[56] References Cited

U.S. PATENT DOCUMENTS

| | | | |
|---|---|---|---|
| 1,048,556 | 12/1912 | Mackie | 229/84 |
| 1,299,503 | 4/1919 | Pente | 229/54 R |
| 2,400,759 | 5/1946 | Katz | 229/54 R |
| 2,538,585 | 1/1951 | Oden | 229/62 |
| 2,781,161 | 2/1957 | Adams | 229/62 X |
| 3,977,596 | 8/1976 | Gamble | 229/62 |

*Primary Examiner*—Stephen P. Garbe
*Attorney, Agent, or Firm*—Townsend and Townsend

[57] ABSTRACT

Apparatus and method for bailing newspapers so that they can be easily transported for recycling is disclosed. A paper bag is provided which has an interior volume adapted to receive a stack of newspapers through its normally open end. The bag includes mirror image juxtaposed patterns of slits on opposite sides of the bag near the open end. Each pattern of slits includes a first generally transverse slit adapted to define a handle element. A pair of slits depend from proximate the first transverse slit to define a flap element in which the tip is narrower than the base. A second transverse slit is located at the base of the flap element to define a slot. The flap elements on opposite sides of the bag are adapted to fold over the stack of newspapers within the bag and each other, and the upper ends of each flap element are adapted to fit into the slot of the other respective element, to encapsulate the newspapers in the bag. The newspapers can thus be easily transported by grasping the handle elements of the bag.

12 Claims, 13 Drawing Figures

NEWSPAPER RECYCLING APPARATUS AND METHOD

This application is a continuation in part of my previous application of the same title, Ser. No. 506,090, now U.S. Pat. No. 3,977,596, filed Sept. 16, 1974.

BACKGROUND OF THE INVENTION

The present invention relates to recycling systems, and in particular to apparatus and method for bailing newspapers so that they can easily be transported for recycling.

The increasing need for recycling paper and other materials to minimize the depletion of raw material resources is becoming more and more apparent. The depletion of natural timber resources, particularly for papre products and especially for newsprint, is rapidly becoming a critical problem. One of the obvious solutions to this problem is to recycle newspapers so that the newsprint is reused rather than continuously exhausting raw timber resources.

In the past, two problems have hindered the widespread acceptance of recycling newpapers. The first problem was that the monetary value of the recycled newspapers on a per ton basis was relatively small so that the expenses of collecting the newspapers outweighed the value. Economically feasible collection of the newspapers could only be performed by volunteer organizations, such as boy scout troops and the like. The other problem was that of the inconvenience of tying up bundles of newspapers and was sufficient to hinder the collection of the newspapers unless a secondary motivation such as charity were provided. The newspapers must be bundled and collected relatively frequently since large collections of loose newspapers present a fire hazard and may violate local fire regulations.

The recent increase in the value of raw newsprint has virtually eliminated the first problem mentioned above, and it is now becoming economically feasible and attractive to collect newspapers for recycling. Pilot programs have been initiated to determine whether the public is willing to accommodate newspaper recycling and accept the minor inconveniences involved in collecting and bundling the newspapers for periodic collection. These pilot programs have shown limited success, and the unwillingness of the public to put up with minor inconveniences such as bundling newspapers has proven to be difficult to overcome. Since used newspapers must be disposed by the consumer anyway, it would appear that a collection system which was no more inconvenient than normal trash disposal would avoid this public antipathy and render widespread recycling a feasible concept.

SUMMARY OF THE INVENTION

The present invention provides apparatus and a method for bailing newspapers so that they can be easily transported for recycling. A paper bag is provided which has an interior volume adapted to receive a stack of newspapers through its normally open end. The bag includes mirror image juxtaposed patterns of slits on opposite sides of the bag near the open end. Each pattern of slits includes a first generally transverse slit adapted to define a handle element. A pair of slits depend from proximate the first transverse slit to define a flap element in which the tip is narrower than the base. A second transverse slit is located at the base of the flap element to define a slot. The flap elements on opposite sides of the bag are adapted to fold over the stack of newspapers within the bag and each other, and the upper ends of each flap element are adapted to fit into the slot of the other respective element, to encapsulate the newspapers in the bag. The newspapers can thus be easily transported by grasping the handle elements of the bag.

Newspapers can be collected and inserted in the paper bag on a daily basis as they are used much as ordinary trash is now collected in a trash bag. As a result, the present method for collecting newspapers is as convenient as collecting ordinary trash. Furthermore, the preferred embodiments of the present invention provide handle on the bag so that the collected newspapers can easily be carried to the designated location for periodic collection. The basic size of the bag is similar to the normal shopping bags used in supermarkets which may issue them as a sales promotion and the bags themselves can carry advertising on the sides. The bags are preferably made using soluble glue so that the paper bags themselves can also be recycled. The newspapers contained in the paper bags can easily be collected with periodic garbage collection and stored in a separate container in the truck, usually between the wheels beneath the truck bed. The value of the collected newspapers is now such that there is an economic incentive for the trash collector to collect the newspapers and carry them to a recycling center.

This application contains a new embodiment of the present invention not disclosed in the parent application referenced hereinabove. In this new embodiment, a pattern of slits is formed in each of two opposite sides of the bag to define handle and flap elements, rather than the discrete elements which are added to the basic bag construction in the previous embodiments. Preferably, the pattern of slits is slightly discontinuous so that the bag can be used as a normal shopping bag initially, and thereafter the slits can be broken out to form the handles and flaps. The patterns of slits are mirror images of one another so that they can easily be formed by die cutting the bag in its folded configuration after the basic bag has been constructed. This procedure is far more efficient economically than incorporating an independent flap element into the bag, and dramatically reduces the cost of the system. By reducing the cost of the system, the facility with which it can be implemented as a feasible recycling system is greatly enhanced.

The novel features which are characteristic of the invention, as to organization and method of operation, together with further objects and advantages thereof, will be better understood from the following description considered in connection with the accompanied drawings which preferred embodiment of the invention are illustrated by way of example. It is to be expressly understood, however, that the drawings are for the purpose of illustration and description only and are not intended as a definition of the limits of the invention.

DESCRIPTION OF THE PREFERRED EMBODIMENTS

Figure 1:
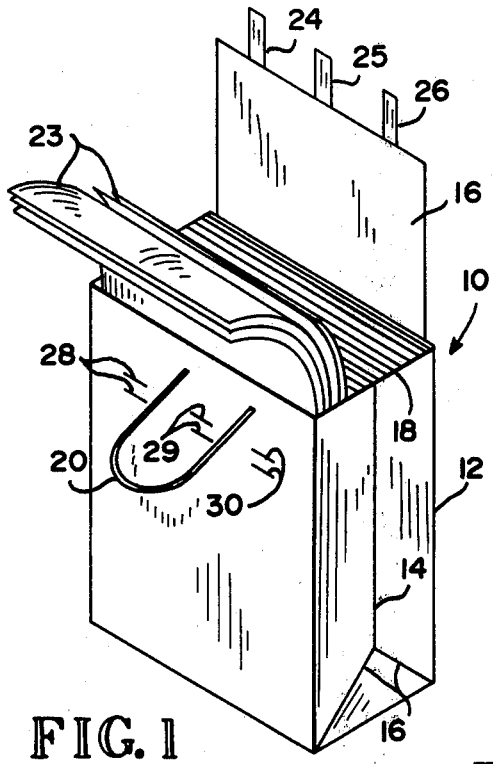
FIG. 1 is a perspective view illustrating the collection of newspapers for recycling according to the teachings of the present invention.
Figure 2:
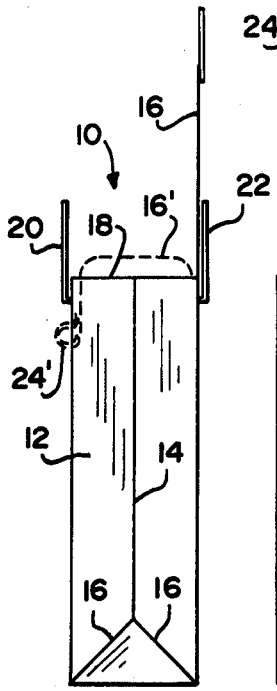
FIG. 2 is an end elevation view of one of the preferred embodiments of the present invention.
Figure 3:
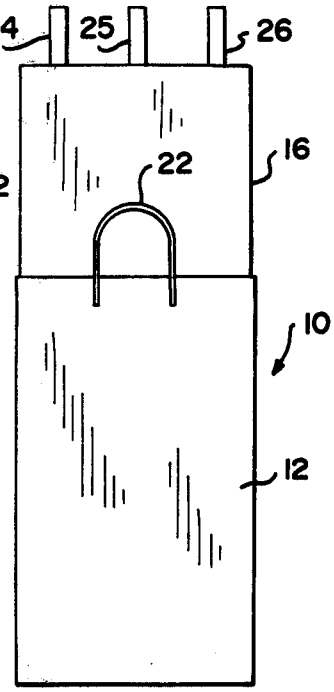
FIG. 3 is a side elevation view of the embodiment of FIG. 2.

One embodiment 10 of the paper bag of the present invention is illustrated by way of reference to FIGS. 1–3. Embodiment 10 includes an upwardly opening paper bag body 12 which is formed by folding the paper and glueing it along seams such as 14, 15 with water-soluble glue. A paper flap 16 extends upwardly from one side of paper bag body 12 adjacent the open end 18 thereof. A pair of handles 20, 22 are attached to the paper bag body 12 adjacent open end 18, handle 22 being disposed on the exterior of flap 16.

A plurality of newspapers such as 23 can be easily inserted into paper bag body 12 through open end 18. After the newspapers are inserted, flap 16 can be folded over the disposed ends of the newspapers as illustrated at 16' in FIG. 2. A plurality of tabs 24–26 are located on the free end of flap 16, and a row of corresponding parallel slits 28–30 are formed in bag body 12 opposite from the attachment of flap 16. Flap 16 can thus be folded along the inside surface of bag body 16 to enclose the newspapers 23 therein, and the tabs such as 24 inserted outwardly through one of the parallel slits 30 and inwardly through the other to encapsulate the newspapers in the bag.

Figure 4:
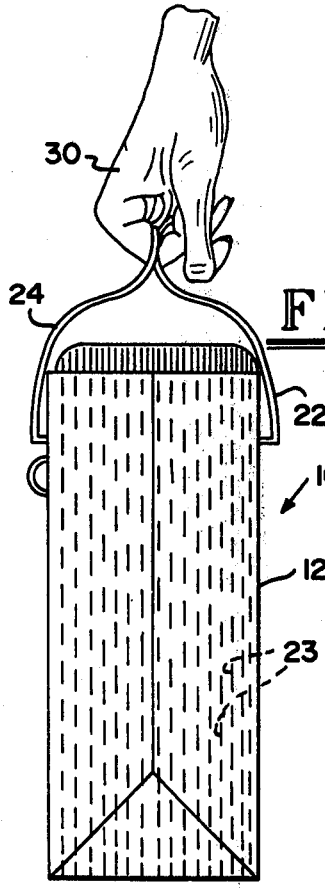
FIG. 4 illustrates the manner of carrying the newspapers for recycling using the embodiment of the present invention illustrated in FIGS. 2 and 3.

After newspapers 23 have been encapsulated in bag body 12, handles 20, 22 remain exposed as illustrated in FIG. 4. This allows a person to use his hand 30 to grasp the handles for easy carrying of the newspapers. Embodiment 10 is constructed using soluble glue so that the entire unit including newspapers, paper bag, and handles can be fully recycled.

Figure 5:
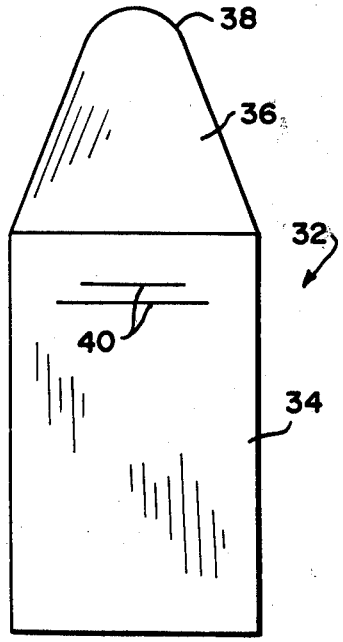
FIG. 5 is a side elevation view of a second embodiment of the present invention.

A second embodiment 32 of the present invention is illustrated by way of reference to FIG. 5. Embodiment 32 includes paper bag body 34 as illustrated in the previous embodiment. However, flap 36, attached to one side of bag body 34 adjacent its opened end, is tapered and comes to a single point 38 forming a tab. Tab 38 can readily by folded over the newspapers and inserted through parallel slits 40 to bail the newspapers. The disadvantage of the embodiment 32 as illustrated in FIG. 5 is that no handles are provided on the bag body, making it relatively more difficult to carry than the initial embodiment.

Figure 6:
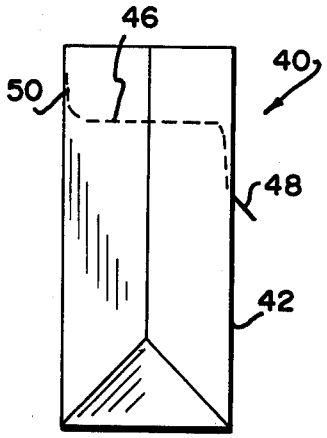
FIG. 6 is an end elevation view of a third embodiment of the present invention.
Figure 7:
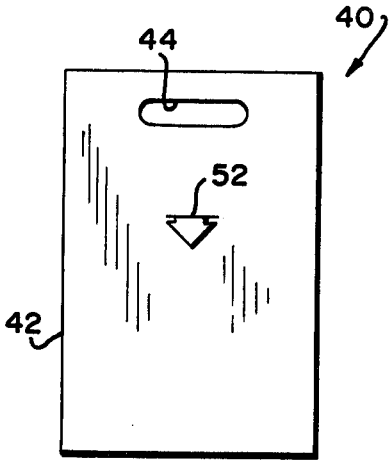
FIG. 7 is a side elevation view of the third embodiment.
Figure 8:
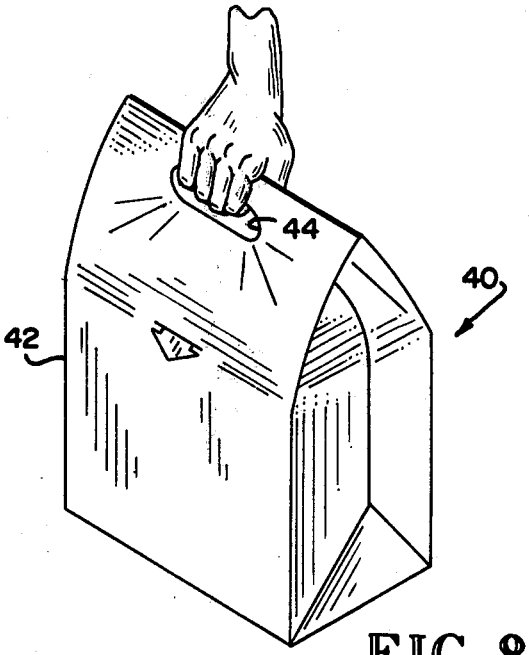
FIG. 8 is a perspective view of the third embodiment of the present invention illustrating the manner in which this embodiment can be carried by the handles.

A third embodiment 40 of the present invention is illustrated by way of reference to FIGS. 6–8 in combination. Embodiment 40 includes a standard rectangular paper bag body 42 provided with slots 44 on either side which can be used as a handle. A flap 46 is provided on the interior of bag body 42 and has an arrow-shaped tab 48 at the free end thereof. Flap 46 is attached to bag body 42 at 50 so that flap 46 normally projects downwardly inside the bag so that the bag can be initially used for purposes other than bailing newspapers as a standard paper bag. Bag body 42 has a configuration generally similar to a supermarket bag with slightly raised sides.

Newspapers can be collected and stacked inside bag body 42 as in the previous embodiments. The height of bag 42 is such that the newspapers will not extend to the top of the bag but rather a few inches clearance will be allowed. Flap 46 can thus be folded over the tops of the newspapers and then downwardly and inwardly along the inside surface of the far side of the bag as illustrated in FIG. 6. Arrow-shaped tab 48 can then be inserted through a complementary slit 52 to lock the flap 46 in position (see FIG. 7). The newspapers can then be easily transported for recycling by grasping bag body 42 through slots 44 which provide a handle, as illustrated in FIG. 8.

Figure 9:
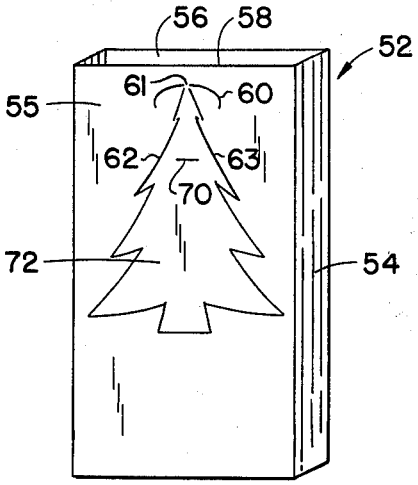
FIG. 9 is a perspective view of a fourth embodiment of the present invention.
Figure 10:
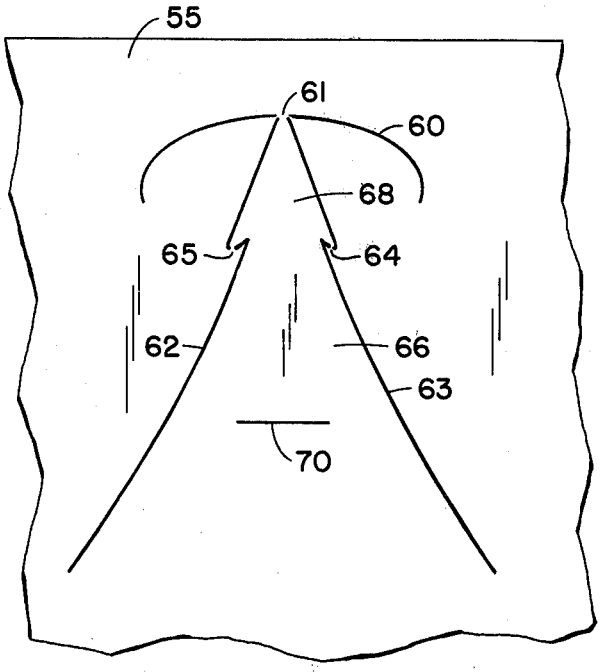
FIG. 10 is an enlarged fragmentary view of the fourth embodiment depicting the slit pattern of one side of the bag.

A fourth embodiment 52 of the present invention is illustrated by way of reference to FIGS. 9–11. As illustrated in FIG. 9, embodiment 52 comprises a bag 54 having the shape of a normal shopping bag. The bag has a rectangular plan section providing two relatively wide sides 55, 56. One end 58 of bag 54 is normally open so that the bag can be used as a normal shopping bag.

A patter of slits is provided in each of the opposite sides 55, 56 of bag 54 proximate its open end 58, as illustrated in FIGS. 9 and 10 in combination. The patterns of slits on sides 55, 56 of bag 54 are mirror images of one another. Each pattern of slits includes a generally transverse slit 60 having a downwardly curved crescent shape as illustrated. A discontinuity 61 is preferably provided at the center of transverse slit 60. A pair of slits 62, 63 depend from proximate transverse slit 60 at discontinuity 60. Slits 62, 63 are not continuous to transverse slit 60. Also, discontinuities 64, 65 may be provided along slits 62, 63. As a result, until the discontinuities have been broken out of the slits, the sides 55, 56 of the bag will retain their flat configuration as illustrated in FIG. 10, and bag 54 can be used as a normal shopping bag.

Depending slits 62, 63 define a flap element 66. The upper end of flap element 66 preferably has an arrowhead configuration as illustrated at 68. The lower portion of flap element 66 is wider than the upper portion 68, and includes a transverse slit 70. If desired, the design of an evergreen tree 72 may be provided on the side of the bag as illustrated in FIG. 9, and slits 62, 63 can coincide with the perimeter of design 72 to enhance the aesthetics of the bag.

Figure 11A:
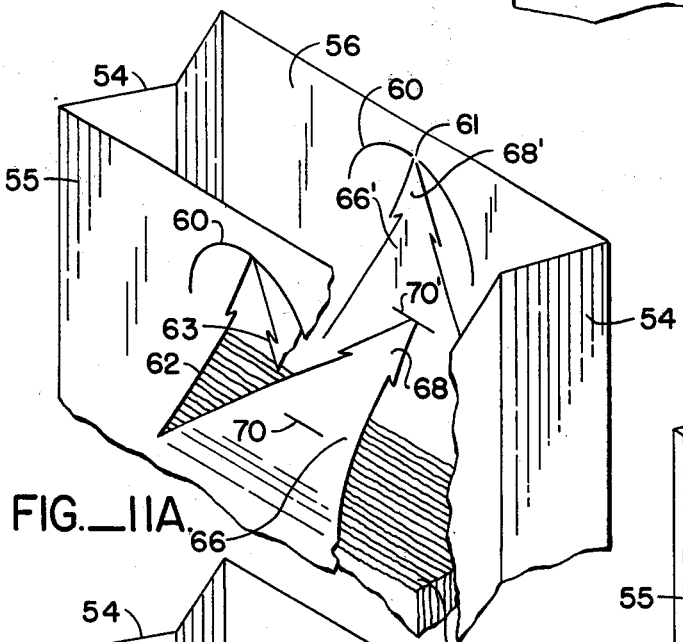
FIGS. 11A, B and C are fragmentary perspective views illustrating the sequence employed to encapsulate the newspapers within the bag using a fourth embodiment of the present invention.
Figure 11B:
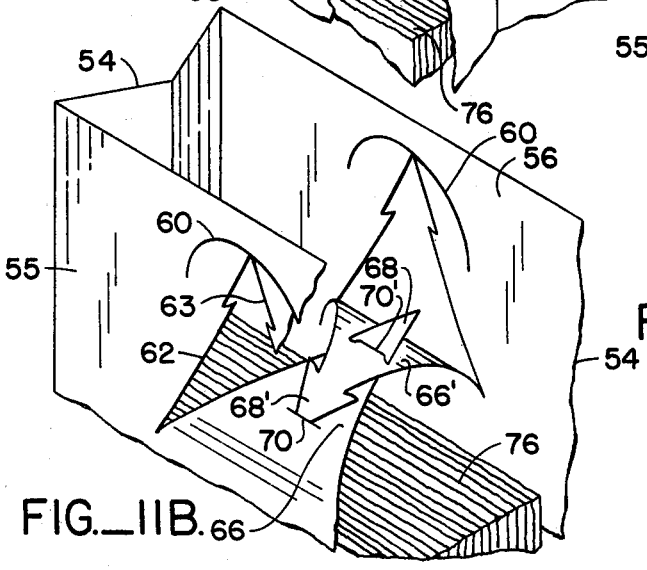
Figure 11C:
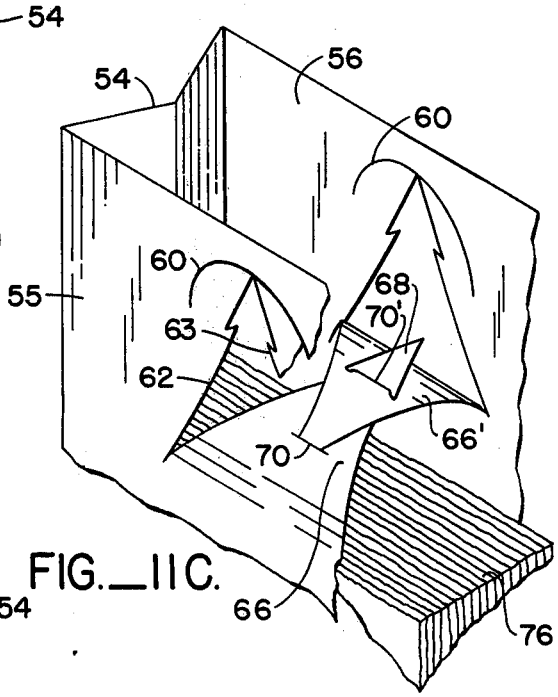

After a stack of newspapers 74 has been loaded in bag 54, they can be encapsulated therein as illustrated by way of reference to FIGS. 11A–C. First, as shown in FIG. 11A, flap element 66 is detached from the side 55 of bag 54 by breaking out the discontinuities in slits 60, 62 and 63. The arrowhead shaped tip 68 of flap element 66 is inserted through a transverse slot 70' in a corresponding flap element 66' on side 56 of the bag.

Referring next to FIG. 11B, flap element 66' is then broken away from its side 56 of the bag. The arrowhead shaped tip 68 of flap element 66 can thus be inserted completely through slot 70' on flap element 66'. Also a corresponding arrow shaped tip 68' on flap element 66' is inserted into slot 70 on flap element 66. As illustrated in FIG. 11C, wherein the arrowhead shaped tips 68, 68' of flap elements 66, 66' are inserted fully through slots 70, 70', newspapers 76 will be completely encapsulated within the bag 54. In addition, transverse slits 60, 60' can be broken out to provide handle elements so that the newspapers encapsulated within bag 54 can readily be transported.

The primary advantage of the fourth embodiment over those illustrated previously is that the flap and handle elements are formed from the basic bag itself, and independent flap and handle elements need not be added to the bag. This is an important economic consideration in view of the fact that the value of the recycled newspapers in any one bag is relatively small, and thus the cost of the bag itself must be kept small so that it does not defeat the purpose of the recycling program. With the fourth embodiment, the pattern of slits can be formed by simply die cutting the bag after it has been constructed in the conventional manner and is in its folded configuration, and thus the cost of the bag is only slightly greater than the normal shopping bag. This economic consideration greatly enhances the feasibility of a recycling system incorporating the apparatus and method of the present invention.

While preferred embodiments of the present invention have been set forth in detail, it is apparent that modifications and adaptations of these embodiments will occur to those skilled in the art. However, it is to be expressly understood that such modifications and adaptations are within the spirit and scope of the present invention as set forth in the following claims.

What I claim as new is:

1. Apparatus for bailing newspapers so that they can easily be transported for recycling, said apparatus comprising a paper bag having an interior volume adapted to receive a stack of newspapers through a normally open end of said bag, said bag including mirror image juxtaposed patterns of slits on opposite sides of the bag generally near said open end, each said pattern of slits including a first generally transverse slit adapted to define a handle element, a pair of slits depending from proximate said first transverse slit to define a flap element, the distance between said depending slits being less at the upper end of said flap element than at a lower portion thereof, and a second transverse slit located between the depending slits at said lower portion of the flap element to provide a slot, the flap elements defined on said opposite sides of the bag adapted to fold over the stack of newspapers within the bag and each other and the upper ends of each said flap element adapted to fit into the slot of the other respective flap element to encapsulate the newspapers in the bag for carrying with the handle elements.

2. Apparatus as recited in claim 1 wherein the upper end of each said flap element includes an arrow-shaped tab adapted to fit through and engage the slot in the other respective flap element.

3. Apparatus as recited in claim 2 wherein the bag includes a design of an evergreen tree on the exterior of at least one of said opposite sides, and wherein the shape of the flap element coincides with the perimeter of the upper portion of the evergreen tree design.

4. Apparatus as recited in claim 1 wherein each said pattern of slits is slightly discontinuous so that the bag can be initially used as a normal shopping bag, and thereafter the slits can be broken out to form the handle and flap elements.

5. Apparatus as recited in claim 1 wherein the first transverse slit has a downwardly curved crescent shape.

6. Apparatus for bailing newspapers so that they can easily be transported for recycling, said apparatus comprising a paper bag having an interior volume adapted to receive a stack of newspapers through a normally open end of said bag, said bag including mirror image juxtaposed patterns of slits on opposite sides of the bag generally near said open end, each said pattern of slits including a first generally transverse slit adapted to define a handle element and having a slight discontinuity near the center thereof, a pair of slits depending from immediately proximate the discontinuity of said first transverse slit to define a flap element, the distance between said depending slits being less at the upper end of said flap element than at a lower portion thereof, and a second transverse slit located between the depending slits at said lower portion of the flap element to provide a slot, the flap elements defined on said opposite sides of the bag adapted to be broken out from the remainder of the bag and fold over the stack of newspapers within the bag and each other and the upper ends of each said flap element adapted to fit into the slot of the other respective flap element to encapsulate the newspapers in the bag for carrying with the handle elements also broken out from the remainder of the bag.

7. Apparatus as recited in claim 6 wherein the upper end of each said flap element includes an arrow-shaped tab adapted to fit through and engage the slot in the other respective flap element.

8. Apparatus as recited in claim 7 wherein the bag includes a design of an evergreen tree on the exterior of at least one of said opposite sides, and wherein the shape of the flap element coincides with the perimeter of the upper portion of the evergreen tree design.

9. Apparatus as recited in claim 6 wherein the first transverse slit has a downwardly curved crescent shape.

10. Apparatus for bailing newspapers so that they can easily be transported for recycling, said apparatus comprising a paper bag having an interior volume adapted to receive a stack of newspapers through a normally open end of said bag, said bag including mirror image juxtaposed patterns of slits on opposite sides of the bag generally near said open end, and a design of an evergreen tree on the exterior of at least one of said opposite sides, each said pattern of slits including a first generally transverse slit adapted to define a handle element, a pair of slits depending from proximate said first transverse slit to define a flap element, the distance between said depending slits being less at the upper end of said flap element than at a lower portion thereof and the shape of the flap element coinciding with the perimeter of the upper portion of the evergreen tree design, and a second transverse slit located between the depending slits at said lower portion of the flap element to provide a slot, the flap elements defined on said opposite sides of the bag adapted to fold over the stack of newspapers within the bag and each other and the upper ends of each said flap element adapted to fit into the slot of the other respective flap element to encapsulate the newspapers in the bag for carrying with the handle elements.

11. Apparatus as recited in claim 10 wherein each said pattern of slits is slightly discontinuous so that the bag can be initially used as a normal shopping bag, and thereafter the slits can be broken out to form the handle and flap elements.

12. Apparatus as recited in claim 10 wherein the first transverse slit has a downwardly curved crescent shape.

* * * * *